US007322885B1

(12) United States Patent
Luciano, Jr. et al.

(10) Patent No.: US 7,322,885 B1
(45) Date of Patent: Jan. 29, 2008

(54) LOTTERY GAME TICKETS AS PRIZES IN GAMES OF CHANCE

(75) Inventors: Robert A. Luciano, Jr., Reno, NV (US); Loren T. Nelson, Reno, NV (US)

(73) Assignee: Sierra Design Group, Las Vegas, NV (US)

( * ) Notice: Subject to any disclaimer, the term of this patent is extended or adjusted under 35 U.S.C. 154(b) by 415 days.

(21) Appl. No.: 10/701,166

(22) Filed: Oct. 31, 2003

Related U.S. Application Data

(60) Provisional application No. 60/423,105, filed on Nov. 1, 2002.

(51) Int. Cl.
*A63F 9/24* (2006.01)

(52) U.S. Cl. ..... 463/17; 463/26; 273/138.1

(58) Field of Classification Search ..... 463/16–17, 463/25–28; 273/138.1, 269
See application file for complete search history.

(56) References Cited

U.S. PATENT DOCUMENTS

2001/0036854 A1* 11/2001 Okuniewicz ..... 463/17
2001/0036855 A1* 11/2001 DeFrees-Parrott et al. .... 463/17
2002/0093136 A1 7/2002 Moody
2003/0181236 A1* 9/2003 Okuniewicz ..... 463/17

* cited by examiner

*Primary Examiner*—Robert E. Pezzuto
*Assistant Examiner*—Alex F. R. P. Rada, II
(74) *Attorney, Agent, or Firm*—Steptoe & Johnson LLP

(57) ABSTRACT

A system and method of increasing player interest in gaming machines is disclosed by the use of lottery tickets as prizes. Lottery ticket purchasing pools are funded from either coin-in (wagers), coin-out (winnings), or in networked gaming systems from player tracking funding (promotional funding). The lottery ticket funding pools build value to a predetermined level, and then individual game machines' printers are issued instructions to print lottery tickets (or vouchers redeemable for lottery tickets) to players. This enables an alternative to traditional progressives while providing similar player interest and excitement while using fewer casino resources than traditional progressives.

13 Claims, 6 Drawing Sheets

Figure 1

Example Tables From A 32 Stop/Reel, 3 Reel, Evenly Weighted, Single Payline Slot Machine

| Combination | Reel 1 | Reel 2 | Reel 3 | Total Hits | Pay | Total Pay |
|---|---|---|---|---|---|---|
| Sun Sun Sun | 2 | 2 | 2 | 8 | 1200 | 9600 |
| 3Bar 3Bar 3Bar | 3 | 3 | 3 | 27 | 90 | 2430 |
| 2Bar 2Bar 2Bar | 4 | 4 | 4 | 64 | 60 | 3840 |
| Bar Bar Bar | 6 | 6 | 6 | 216 | 30 | 6480 |
| Face Face Face | 1 | 1 | 1 | 1 | 15 | 15 |
| Any Any Face | 26 | 26 | 1 | 676 | 2 | 1352 |
| Any Face Any | 26 | 1 | 26 | 676 | 2 | 1352 |
| Face Any Any | 1 | 26 | 26 | 676 | 2 | 1352 |
| Any Face Face | 26 | 1 | 1 | 26 | 6 | 156 |
| Face Any Face | 1 | 26 | 1 | 26 | 6 | 156 |
| Face Face Any | 1 | 1 | 26 | 26 | 6 | 156 |
| Tix Tix Tix | 16 | 16 | 16 | 4096 | 1 | 4096 |
| | | | | | | |
| Total | | | | 6518 | | 30985 |

Table 1A
Complete Payout Listing

| Reel Wins | 1 Coin | 2 Coin | 3 Coin |
|---|---|---|---|
| ☼☼☼ | 1200 | 2400 | 3600 |
| ≡≡≡ | 90 | 180 | 270 |
| ═══ | 60 | 120 | 180 |
| ––– | 30 | 60 | 90 |
| ☺☺☺ | 15 | 30 | 45 |
| Any Two ☺☺ | 6 | 12 | 18 |
| Any One ☺ | 2 | 4 | 6 |
| Three Tix | 1 Ticket | 2 Tickets | 4 Tickets |

Table 1B
Visible To Players On Slot Machine

Lottery Tickets As Paytable Awards: Central Determination Games

Incentive Sales Of Lottery Tickets: Cash-Out And Voucher Kiosk

Gaming Machine For Lottery Ticket Prize Issuance

Gaming Machines With Local And Centralized Lottery Ticket Issuance And Accounting In Networked And Non-networked Environments Multiple Lottery Choices For Lottery Ticket Prizes

LOTTERY GAME TICKETS AS PRIZES IN GAMES OF CHANCE

RELATED APPLICATIONS

This application claims priority from provisional application 60/423,105 filed on 1 Nov. 2002.

BACKGROUND OF THE INVENTION

1. Field of the Invention

This invention pertains generally to gaming systems. More particularly, the present invention relates to a method and apparatus for providing bonus lottery gaming chances as a winning event in games of chance, increasing player interest thereby.

2. The Prior Art

Game play in standard casino style games is centered around the insertion and usage of coins, paper money, or in some cases vouchers, which gives the player on the machine a certain number of game credits. Game credits usually correspond to one pull of a lever, push of a game play button to initiate one game play, or one play of a the cards (depending on the game being played). Players play the game and either win or lose that game. This is called the primary game.

In order to enhance player interest and participation in the primary game, gaming manufacturers have added two kinds of additional game play to the primary game. The first kind of additional play is called a bonus game play, where a secondary game is played by a player upon the occurrence of certain events (sets of gaming symbols or outcomes) in the primary game. "Wheel Of Fortune"® gaming machines by IGT® are a typical example. Upon a certain winning sequence of symbols occurring in the primary game, the player is sent to the bonus game, where a wheel spins. The wheel stops on a number that acts as a multiplier for the amount won in the primary game, awarding the player extra credits. A significant limitation to player interest in games having a secondary game or bonus game is their limited additional win amounts. Only relatively small adders are available to be won in single machine bonus games.

The second type of extra or bonus winnings comes from "progressive bonuses" or simply "progressives." This was designed to overcome the small payout associated with the bonus or secondary games discussed above. Progressive bonus play differs from prior bonus play in that multiple machines contribute to a common pool, winnable by a player of an individual machine upon the occurrence of specified randomized events. Progressives are funded by taking a fixed portion (percentage) of each wager made by players at individual machines, where the fixed portion of the wagers are collected into a single pool or pot to be won by a single player. Because a large number of machines are contributing to this common pool (amount of money collected), it is significantly larger than that available on a single machine. It is the larger pools that create the additional player interest and excitement; however there is corresponding smaller amount of likelihood an individual will be the winner of the larger pool.

There is a need to increase player interest and participation in primary games through the use of incentives that pay larger amounts than the single-gaming-machine secondary games, but are perceived by the players as having a higher likelihood of winning as compared to the large but very infrequently won progressive pools.

BRIEF DESCRIPTION OF THE INVENTION

Disclosed is a new and novel system and method for using lottery tickets as prizes with games of chance. The games of chance are traditional Nevada-style games (typically slot machines, either mechanical or video), games of chance in central determination jurisdictions such as those used in Amerindian casinos in Washington State, and games of chance conforming to Class II requirements as defined in IGRA, 25 USC § 2701 et seq. The lottery tickets being used as prizes correspond to entries into lotteries of any type. The lotteries may external to the casino (this is particularly attractive to smaller casinos who don't have the volume or resources to have traditional progressives), and are expected to be state-run, state-sponsored, or state-sanctioned lotteries. The lottery may also be a private lottery, run by a casino (would typically be a larger casino) or other private entity or consortium.

Whatever lottery is being used as the source of the tickets (may also be more than one lottery simultaneously), the present invention enables gaming machines or a gaming system controlling printers in the gaming machine or otherwise physically accessible by players to issue lottery tickets for the chosen lotteries or lottery. This is in addition to any other winnings and prizes already available being issued to players, creating extra interest and excitement.

There are several preferred embodiments for paying for the lottery tickets issued as prizes to players. One is as a percentage if coin-in (wagered amounts), another is coin-out (winnings), and a third is from promotional funds (those funds typically used by casinos for player rewards such as diners, hotel rooms, etc.). The present invention is not limited to those aforementioned funding sources; any funding method may be used that enables a casino to purchase lottery tickets for a lottery and make the tickets available to players. Further, if the lottery is an internal, private lottery the funding may be unrelated to player input at all; the casino may simply issue a predetermined number of tickets or issue tickets over a predetermined amount of time upon the occurrence of specified game or player events, and then hold the drawing for the lottery. Note that the funding source for the tickets themselves is not the same as the funding for the lottery. The lottery is funded however each lottery is funded and that funding is completely separate from the methods to fund purchase of lottery tickets as described herein.

The lottery ticket prizes are issued directly by a game (game of chance), if the game has lottery tickets in its paytables. If the game does not have lottery tickets in its paytables (the more common situation, and will the situation when retrofitting the present invention in existing casino infrastructures), then there will be a software package called a lottery ticket prize manager or lottery manager that will keep basic accounting (the amount of credits or prizes in the lottery ticket purchasing pool) and will issue tickets. The lottery manager may reside in an individual gaming machine, another type of game device such as a redemption kiosk, a game controller (controls a bank of gaming machines, typically eight machines but is very variable), or on a back end system to which individual gaming machines, or banks of machines, are networked. The methods used to determine when and where to dispense lottery tickets are discussed more fully below.

BRIEF DESCRIPTION OF THE DRAWINGS

FIG. 1 shows an exemplar paytable according to the present invention.

DETAILED DESCRIPTION OF THE INVENTION

Figure 2:
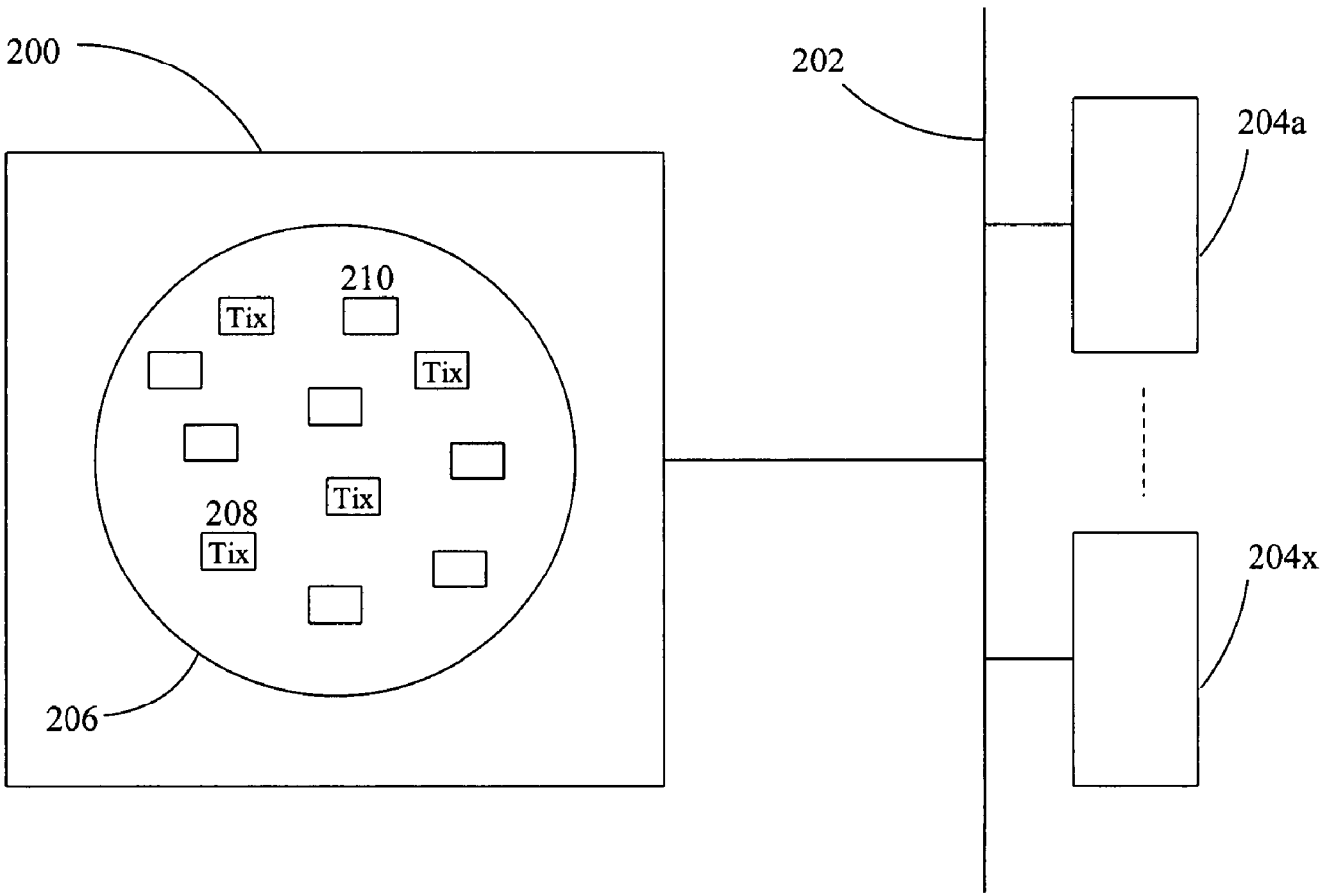
FIG. 2 is a block diagram of a central determination gaming system according to the present invention.

Persons of ordinary skill in the art will realize that the following description of the present invention is illustrative only and not in any way limiting. Other embodiments of the invention will readily suggest themselves to such skilled persons having the benefit of this disclosure.

Referring to the drawings, for illustrative purposes the present invention is shown embodied in FIGS. 1 through 6. It will be appreciated that the apparatus may vary as to configuration and as to details, implementation, and functionality of the parts, and that the method may vary as to details, partitioning, and the order of the acts, without departing from the inventive concepts disclosed herein.

The present invention provides a method for making use of both in-house and external lotteries by issuing tickets to the lotteries as prizes for certain events while playing traditional games of chance. External lotteries are typically run by the local or state government but may be any lottery, public or private. The present invention further provides for the issuance of lottery tickets during player use of cash-in/cash-out machines or when players use vouchers or cash-out slips during game play or for game wins (cash-out slips are prominent in smaller casinos but are uncommon in larger casinos; voucher use occurs in both small and large casinos).

A distinct advantage of the present invention is that it creates an easy, automated way for players to participate in the additional excitement of lottery drawings as a result of playing traditional games of chance, while requiring no or minimal investment on the part of the casinos. This allows casinos using the present invention to present players with a competing product to progressives, or can be used as an adder to traditional progressives. Smaller casinos may compete, using the present invention, with casinos that have the internal resources to create large progressives, while requiring minimal investment of a smaller casino.

FIG. 1 illustrates one embodiment of the present invention. In this embodiment a traditional Nevada-style gaming machine includes, in its paytable, winning events that result in the issuance of a lottery ticket as a prize. This can be characterized as "built into" the game; that is, the issuance of lottery tickets is part of the paytable of the game itself. Later embodiments illustrate methods of using lottery tickets as prizes that are not part of the actual game's paytables, being usable with any game without modifying it. Returning to the embodiment of issuing lottery tickets as prizes built into the game, table 1B shows the payouts as seen by a player, usually on the game glass. In addition to issuing coins or credits, the reels have symbols, in this example called "Tix", which will result in the issuance to the player of one or more lottery tickets rather than credits. Note that the player may be issued lottery tickets directly (for in-house lotteries and external lotteries enabling an electronic connection to the casino), or may be issued a voucher, token, or special cash-out ticket redeemable for a lottery ticket at a cashier's station (in cases where an electronic link is prohibited or unavailable). Table 1A shows the complete payout tables for a machine according to the present invention. Note that this is a per unit paytable, and the tickets are valued at one credit. Clearly, this will be used in cases where the lottery that supplies the source of tickets has a ticket purchasable for an equivalent sum; paytable amounts and lottery ticket prices must be convertible between themselves (not necessarily identical; in a preferred embodiment the lottery tickets' retail value or purchase price would be equal to, or an even multiple of, the credit or wagering amount of the gaming machine being played). This is an exemplar paytable; any game of chance can be used with the present invention by providing certain events that result in lottery tickets being issued instead of credit or monetary payouts.

FIG. 2 is a block diagram showing a central determination gaming system configured for use with the present invention. Central determination system refers to systems using a fixed (pre-determined) result for game play results. A fixed pool or predetermined outcome game is one in which a specified amount of money or number of prizes (the prizes having calculable monetary equivalents) are distributed into a set of individually purchasable and winnable units, some of which will be prizes and some of which will be no-wins (zero-value game result units). Each individual unit has a known cost, including the purchasable units having no prize. Thus, the total amount of prizes, the prize distribution (i.e., the number of prizes at each level), and the total return to the casino if all individually purchasable units are sold are known at the game's outset. Alternatively, the prize may be predetermined using a random event on a central server upon each game play request coming from an individual game machine.

The individually purchasable units are typically generated and distributed as tickets. The two most common form of tickets are pull tab tickets, called pulltabs, and scratch-off tickets, called scratchers. This also applies to traditional lotteries. Returning to pull tab tickets, they are typically constructed from paper of various thickness, having two layers. The first layer has some type of indication of the purchasers' winnings, if any, and the second layer covers the first. The second layer is typically glued to the first layer around three edges, covering the results. The fourth edge typically has a small tab, allowing the purchaser to grab hold of it. The tab, upon being pulled, pulls the layers apart and reveals the purchasers' winnings, if any. Scratchers use an opaque material that covers portions of the ticket, where the covered portions have the predetermined results on them. The purchaser scrapes off the opaque material, revealing any winnings.

When done in an electronic form, this is referred to as a central determination game because there is a central electronic pool (or a centrally generated outcome) from which game results are selected (or generated) as sent to each game for each game play. This is different than Nevada-style games, where each game play result is determined by the game machine. A player puts credits or money into a machine, shown in FIG. 2 as gaming machines 204*a* through 204*x*. Each machine is connected via a network 202 to a backend server 200 having a prize pool (or prize generator)

206 therein. A game play result (including empty or 0 value results) is randomly generated/selected and sent to the game, which displays the result in various ways. The game machines, individually, do not generate any game results; they display what they are sent by the backend server.

Class II games are also included in the types of games usable with the present invention. Some class II games are configured similarly to Nevada-style games (standalone) described earlier; and some are configured similarly to, or the same as, the central determination games just described. The present invention is usable with both types.

Exemplar pool 206 shows individual prize pool elements 208 and 210 (as exemplar elements). Element 210 stands for a standard monetary prize. Prize pool element 208 illustrates an element according to the present invention; it equates to the player at a participating game machine being awarded a lottery ticket rather than credits (monetary prizes). Note that the lottery ticket itself is preferably printed at the game machine and issued directly to the player; if for some reason there is no electronic connection between the lottery body (state run lottery or private lottery), then a voucher which a player can redeem for a lottery ticket is issued. A further embodiment issues players vouchers redeemable for lottery tickets at a later time, enabling the player to choose when to enter the lottery (i.e., they can wait until the lottery pool is large, for example, and then use the voucher to get a ticket for the large drawing rather than a previous smaller one). If prizes are generated using a random number generator, then there will be a mapping of specified events that correspond to the issuance of lottery tickets.

Figure 3:
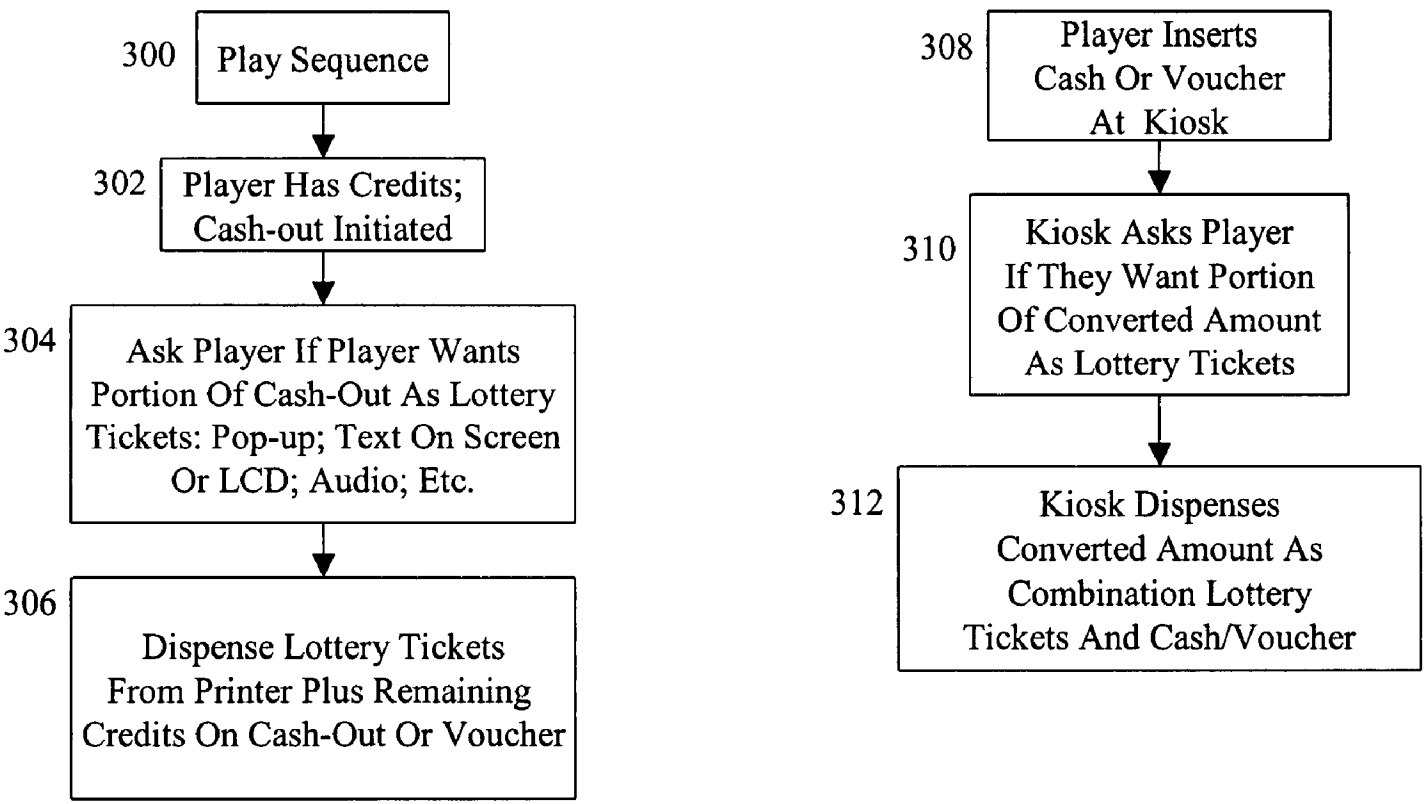
FIG. 3 is a flow diagram of lottery ticket sales enabled at cash/voucher kiosks and during cash-out at gaming machines.

FIG. 3 illustrates methods of enabling players to purchase lottery tickets at other points in the playing process. This embodiment is very flexible, being usable with or without the game being played having lottery tickets in its paytables. Box 300 corresponds to a player playing a gaming machine (Nevada-style or central determination). Continuing into box 302, the actions carried out are those associated with a player indicating they want to cash-out of the machine currently in use. Continuing into box 304, the machine responds by inquiring if the player wants to use some or all of their credits to purchase lottery tickets. The player can be made award of their choice by text means on a screen, including a pop-up bubble having a textual inquiry therein, using audio output in the form of an inquiry to the player, etc. The player will use either buttons or a touchscreen to indicate how many tickets they would like. Continuing into box 306, the game machine will then issue lottery tickets and credits, as desired by the player.

Box 308 corresponds with a player converting cash to vouchers (for cashless or bill-less gaming) or voucher back to cash. Although geared towards an automated kiosk, the process applies to manned stations as well. A player presents either cash or vouchers to an exchange kiosk. Upon receiving the player's cash or the player's voucher, box 308 is left for box 310 which corresponds to the kiosk indicating to the player (through the use of text and/or icons on a display or audio messages, or if manned being asked by the attendant) if they wish to have lottery tickets as well as the cash/voucher to be issued. The player indicates, typically through a touchscreen, the number of lottery tickets they want in addition to the changed cash/vouchers. This can be any number from 0 to the purchasing equivalent of the amount to be exchanged. Continuing into box 312, the actions taken correspond to those where the kiosk will issue a specified number of lottery tickets (or, an appropriately valued single ticket) to the player, and in addition will provide any remainder in the form of cash or a voucher (whichever the player prefers or is not what was inserted).

Figure 4:
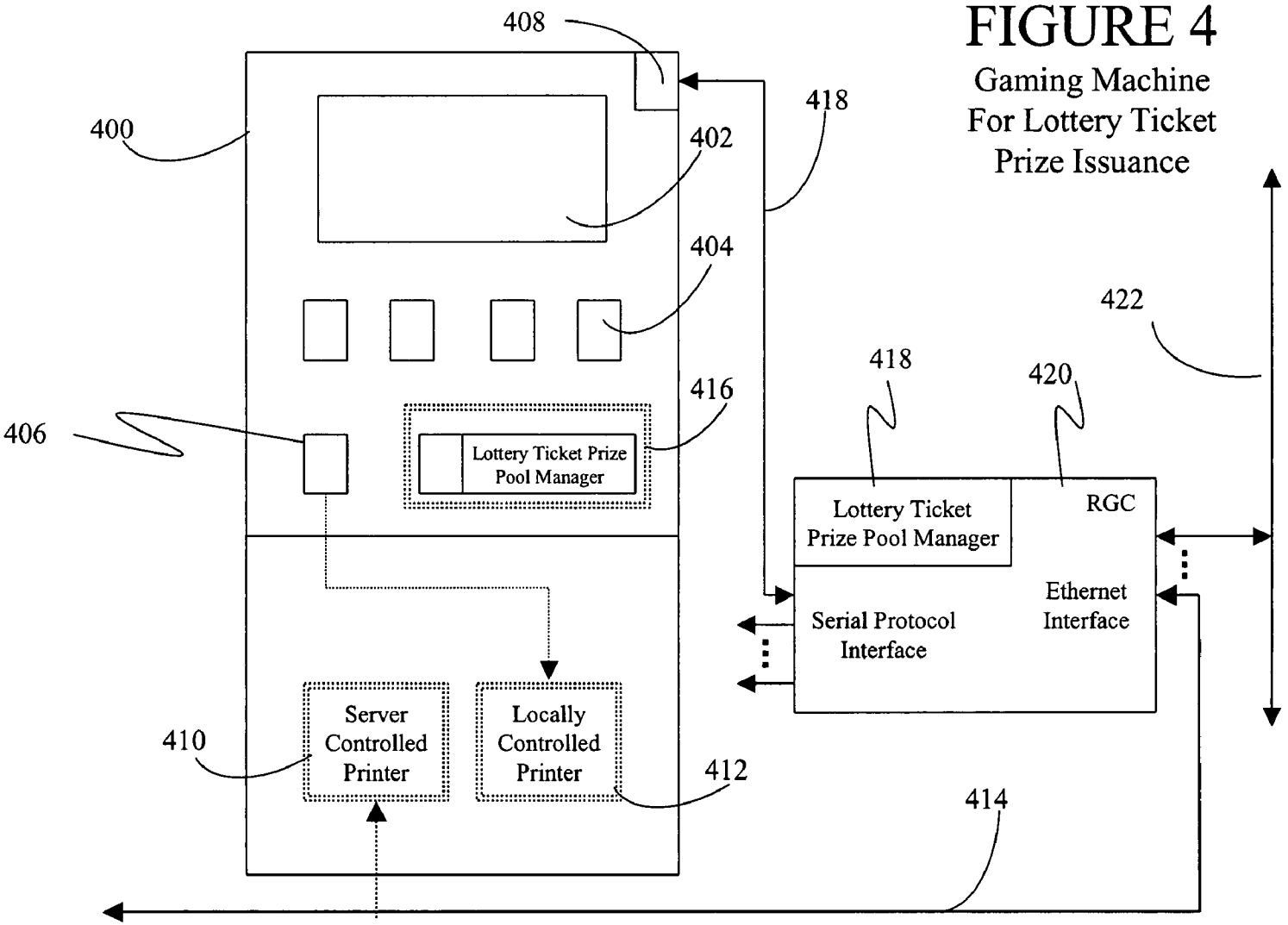
FIG. 4 is a block diagram of a gaming machine configured to issue lottery tickets as game prizes in accordance with the present invention.

Continuing on to FIG. 4, illustrated in block form is a game device 400, video or slot view area 402, a typical SMIB (Slot Machine Interface Board) 408, a serial-protocol-based communications means used over and electronic connection 418 to RGC 420, play buttons 404, input button 406 to locally-controlled printer 410, server controlled printer 412 (as will be clear to a person having skill the art, printer 410 and 412 may be the same physical printer, and button 406 has functionality that my be embodied in any number of fashions such as touch-screen), and a local lottery ticket pool manager 416. Lottery ticket pool manager 416 is software operably disposed within the game as an addition to the other software found in a typical gaming machine, all of which runs on the game machine hardware having at least one programmable processor and associated memory.

Reader 410 is shown connected to RGC 420 via an electronic connection 414. In one preferred embodiment, this will be an Ethernet connection and will interface to RGC 420 via RGC 420's Ethernet port (be on the same Ethernet network 422 as the rest of the backend machines) rather than using the typical serial protocol interface currently found on SMIBs. It is anticipated that in the near future, RGCs such as RGC 420 will no longer be used, in which case printer 410 and game machine 5Game device 400 will continue to communicate with 400 would both be connected via Ethernet (or any other operable communications means) directly to a back end server or computer.

Note that any type of game machine 400 communications devices, now known or not known, are operable with the present invention (as are any type of future gaming machines). Thus, the present invention, shown embodied in gaming machines and associated communications devices currently deployed in use, is also completely operable and usable with future gaming machines, gaming system architectures, and communications technologies as each of those areas continue to evolve.

Also shown in FIG. 4 is a local lottery ticket prize pool manager 416 (or more simply called a lottery manager). A lottery manager may reside in several places, depending on the chosen implementation and the target market, including the game machine itself, an RGC or floor controller (lottery manager 418), or a back end system (not shown, but connected via network connect 422). There is also a case where a separate lottery manager does not exist, that being when the game itself has entries in its paytables for lottery tickets. In that case, the game will trigger the issuance of lottery tickets as part of the payout to the player, and the accounting needed to pay for the lottery tickets by the casino will be part of the accounting information for the game as a whole. If the game itself does not issue lottery tickets as part of the payout embedded within it (in the paytable), a lottery manager will be used.

Example determinants on where to place the lottery manager include retrofitting existing casinos with minimal expense, putting new machines into an existing casino with or without networking capabilities, building a casino from the ground up which allows easy installation of up-to-date communications infrastructure, and, which type of lottery pool is desired. Lottery pools may operate at the individual gaming machine level therefore being on a per machine basis 416), a pool that operates for a bank of gaming machines (418), a casino-wide pool, or a possible combination of these: note that this pool is used to pay for the lottery tickets and is NOT the lottery itself, that is, it is not the lottery's payment pool or the lottery amount.

A lottery manager will have some similar functions regardless of where it is located (an individual gaming machine, an RGC, or on a back end system), as well as differences. The common functions include keeping a total credit amount (equivalent to a dollar amount) and triggering the printing of a lottery ticket. Upon triggering a ticket issuance event, the lottery manager will debit the current pool the amount needed for the casino to pay for the ticket.

For the purposes of this disclosure, "printing a lottery ticket" includes printing, on-demand, an actual lottery ticket but further includes printing a voucher, issuing any other physical media, or crediting a virtual redemption ticket or token, where a player can then trade-in or exchange the token, virtual ticket, etc., for a lottery entry where a "lottery entry" includes any form of entry accepted by a lottery. Lottery entries are typically tickets, such as those used by state-run or state-sponsored lotteries. However, it includes any type of method usable for participating in a lottery, such as storing of a number for a lottery drawing in a database associated with a player, issuing tokens with numbers on them, etc.

In its most basic form, the lottery manager needs to do little more than already described. The lottery manager progresses in complexity from there. If implemented in an RGC, the lottery manager must keep track of the total contribution to the pool from a bank of machines, and keep track of lottery ticket issuance events for the bank of machines. The same additional functionality is required for a casino-wide lottery manager.

Pool funding may be accomplished in several ways. If the game issues lottery tickets directly (the lottery tickets are in the paytable), funding is accounted for in the same way if is for the game in general, using money wagered. If there is a local lottery manager (on the game machine), then the methods used to build the pool to purchase lottery tickets are preferably a percentage of coin-in (wagered amount), accounted for separately from the game winnings paid out by the game paytables, or may be a percentage of winnings, credited to the pool before the remaining portion of the winnings are awarded to the player. The method used by the lottery manager to issue tickets can vary from simple to complex. The simplest method is to issue a lottery ticket each time (i) the pool builds to the point of having enough value to purchase a lottery ticket, and (ii) there is a winning event on the game of any magnitude. This will appear to the player to be an "extra" or bonus win on top of the regular win. An alternative embodiment, preferably used when the pool is built up using coin-in or wagered amount, is to issue a ticket as soon as there is enough value in the pool regardless if the player just had a winning event in the game on the game machine being played. The ticket would be issued upon completion of the next play after reaching the needed value. This would appear to the player as a surprise bonus "win", being generated separately from the game wins.

In another embodiment, rather than issuing a single ticket the pool is built in value until there is enough value for several tickets. The lottery manager can then issue several tickets at a time. A preferred embodiment would us a random number generator output to determine how large to build the pool, within a reasonable range (i.e., the purchasing equivalent of 1 to 10 lottery tickets). As soon as that limit was reached, the lottery manager would then issue the tickets creating additional interest and excitement in players. Upon issuance, another random number between 1 and the maximum number would generated, and the pool built until it reached that number. That number of lottery tickets would then be generated when a player next played the game and issued at the end of the game play. Other variations of pool building and ticket issuance will come to the mind of person skilled in the art and having the benefit of the present disclosure.

Similar methods may be used by lottery managers when used for a bank of gaming machines. The added benefit is that whatever lottery pool funding method is used, the pool will build more quickly than on a single machine which will enable tickets to be issued more often (when viewed as an entire bank). In its simplest form, the lottery manager will keep track of the funding contributed by each machine and issue tickets from the same machine as soon as the pool builds enough value. Alternatively, the funding may all go to a common pool for the bank, and the lottery manager may issue tickets as soon as the pool has enough value based on the next active game machine, the next winning event on any gaming machine in the bank, or may use the results of a random number generator to pick a machine that will have a lottery ticket (or tickets, as per the above description) issue to its player.

If the lottery manager is on a back end system, all the methods previously described may be used, only spread over the entire casino (e.g., all those gaming machines operably in communications with the back end system). In addition to the options already described, this location enables a further preferred embodiment. The lottery ticket pool may now be funded using a new source: the same funding as player tracking and reward systems use. The pool may also be funded using a combination of sources, if that were deemed preferable by the casino. The issuing of tickets may be implemented, at the preference of the casino, in similar ways to that described above. The game machine selection would be made from all the connected machines, rather than just one bank. In a further preferred embodiment, the lottery manager would pick sets of gaming machines (for example, to encourage game play on new or underutilized game machines) and use the contributions from all the gaming machines and/or the player tracking (promotional) source, and then issue lottery tickets to players at the selected subset of machines. This would significantly increase the issuance of tickets on those machines, enough to be quite noticeable to players. In a larger casino this could result in the issuance of a lottery ticket for each game play on the selected machines, resulting in a real feeling of winning for the players.

Figure 5:
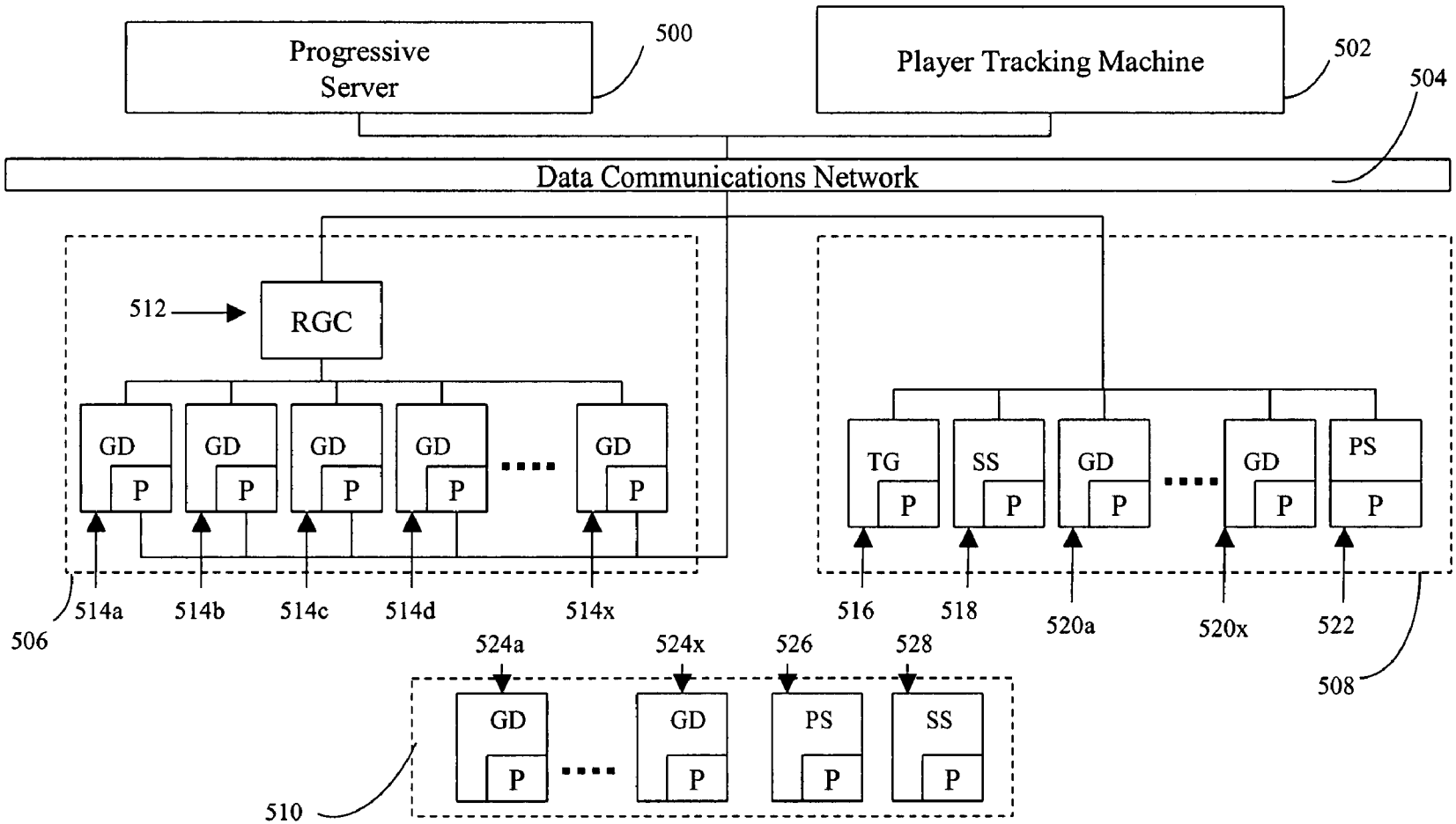
FIG. 5 is a block diagram of a gaming system in accordance with the present invention.

Turning now to FIG. 5, shown is an example of a gaming system having the placement of the lottery managers in several places or subsystems, as suit particular gaming machines (or gaming devices: "GD" in FIG. 5). The subsystems are shown as 506, 508, and 510. FIG. 5 illustrates that a wide variety of systems and subsystems may be utilized with the present invention. Subsystems include those that are both connected and unconnected.

Subsystems 506 and 508 are each operatively coupled for communication to a monitoring or traditional player tracking machine 502 via a data communications network 504. Subsystem 506 comprises a plurality of game devices coupled to a remote game controller (RGC) 512, which could have a lottery manager thereon. RGC 512 is coupled to communication network 704 for communication with backend machines 500 and 502, as well as any other machines that can be addressed directly on the communications network. Subsystem 506 includes individual game devices 514*a*-514*x*, where there can be any number of individual gaming devices between 514*d* and 514*x*. If there are too many for one RGC to support, then there will be more RGCs and each bank of gaming machines will connect to one RGC.

Subsystem 506 also shows that each game device 514*n* has a box labeled as "P" standing for "printer", where the box comprises a printer as described in FIG. 4. The printers are connected directly to the communications network 504.

Subsystem 508 is similar to subsystem 506, but shows an installation where the game devices 520*a*-520*x* do not use an RGC, but connect directly to backbone network 504 (in a preferred embodiment, using ethernet). In this configuration, the functionality described as implemented in the RGC would instead be implemented (in software) within either the player tracking machine 502 or the progressive server 500. Because each machine in subsystem 508 is connected directly to the backbone network, the printers shown do not have a separate connection illustrated. In a preferred embodiment, each printer would use an ethernet connection into the rest of the network (may also be controlled by sending printer control data and messages to the game machine software, if the game machine software is configured to pass the information through to the printer). Also illustrated are the printer's use with table games ("TG"), service stations ("SS", defined as any machine that allows a player to swap between vouchers and cash), and a prize station ("PS", any device where a player may insert a voucher to token to get an actual lottery ticket).

Subsystem 510, unlike subsystems 506 and 508, is not coupled to communication network 504. Each gaming device will be configured as a standalone device, having a lottery manager therein or having lottery tickets in the game's paytable. Shown are gaming devices 524*a* to 524*x*, a prize station 526, and a service station 528.

Subsystem 506 is expected to be a typical installation. Lottery managers may exist in all three locations at the same time, but the preferred embodiment is to have either a lottery manager in progressive server 500 or player tracking server 502.

RGC 512 (corresponding to RGC 420 in FIG. 4) is configured during system initialization to properly correlate each printer (if controllable separately from the gaming machine) with a particular gaming device ("game device" includes, but is not limited to, a game, prize station, service station, player self-service station, attendant service station, or table game station). This association will be permanent until the system is reconfigured by authorized personnel. In one preferred embodiment, this association is managed by a software component residing in the RGC. Thus, all the ticket or voucher data being sent to a printer will also be known by its associated game device.

Figure 6:
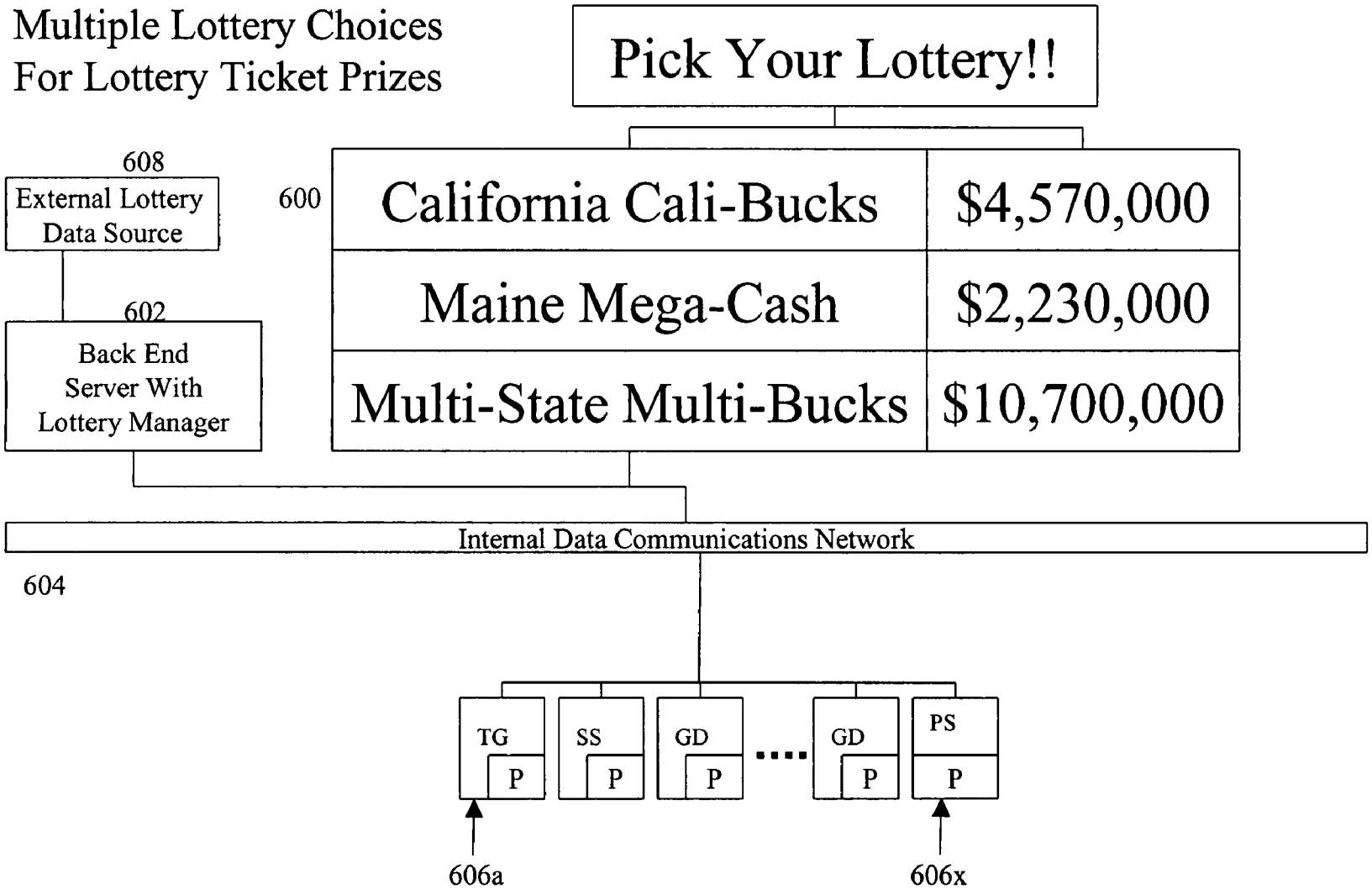
FIG. 6 is a block diagram of a gaming system in offering a player a plurality of lotteries from which to be awarded lottery tickets, in accordance with the present invention.

FIG. 6 shows the use of a plurality of external lotteries in accordance with the present invention. One embodiment will have a sign exemplified by block 600 which shows a plurality of currently running lotteries and their present values. This sign will preferably be visible all or most players, or will be replicated in various visible places in a casino. It will be driven through the casino's backbone network 604, usually using a back end system 602 that receives the data from an outside source 608. The lottery manager, running on system 602 and connected to gaming devices shown generally as devices 606*a*-606*x*, will receive player input as to which lottery the player wants a ticket for from the device. The device will require player input before printing (and will typically have a default lottery from which to issue a ticket in case of a time-out by a player), and is expected to be in the form of a small touchscreen separate from the main screen on the gaming device. If the device is a kiosk or similar device, rather than a game, then the player input device is expected to be the main screen which is also a touchscreen. The player will be shown a set of buttons corresponding to the plurality of lotteries, and the lottery manager will instruct the game device (or the printer directly, depending on the type of connectivity) which lottery ticket to print.

An important property of the present invention is that the disclosed system may be inexpensively integrated into an existing casino's infrastructure, rather than requiring the implementation of an entire replacement system. In addition, there may be a gradual replacement of existing systems, depending on the needs of the casino. It is important to realize that a casino has the option of using the present invention in any part or portion of the casino—it does not need to be used everywhere to be effective. For example, a casino may decide to implement the present invention in areas designated as low-traffic to increase play in that area. Alternatively, a casino may decide to implement the present invention in a high traffic area and additionally implement the system in certain areas (or on certain banks of game machines) in the standard or lower-traffic areas of the casinos, allowing pool funding from the higher traffic areas to fund tickets to the lower traffic areas.

What is claimed is:

1. A method for increasing player interest in a game of chance, comprising:

enabling a gaming machine to receive a wager in the game of chance;

providing a lottery ticket purchasing pool, wherein the lottery ticket purchasing pool is funded at least in part on a portion of the wager; and issuing a lottery ticket if the lottery ticket purchasing pool reaches a predetermined value in response to the wager, wherein the lottery ticket is associated with a player selection of one of a plurality of lottery games.

2. The method of claim 1, further comprising providing a choice to purchase a lottery ticket with a credit in response to receiving a request to cash out.

3. The method of claim 2, further comprising providing a choice of one of a plurality of lotteries from which to purchase a lottery ticket.

4. The method of claim 3, wherein each one of the plurality of lotteries is a state-sponsored lottery.

5. A method for playing a game of chance, comprising:

receiving a wager initiating a game on a gaming machine;

funding a lottery ticket purchasing pool with at least a portion of the wager;

presenting a game outcome of the game; and providing a choice of one of a plurality of lottery games from which to issue a lottery ticket from if the game outcome is a winning outcome.

6. The method of claim 5, further comprising providing the player to opportunity to purchase additional lottery tickets.

7. The method of claim 5, further comprising providing a choice to purchase a lottery ticket with a credit in response to receiving a request to cash out.

8. The method of claim 7, further comprising providing a choice of one of a plurality of lotteries from which to issue a lottery ticket.

9. The method of claim 8, wherein each one of the plurality of lotteries is a state-sponsored lottery.

10. A process for increasing player interest in wagering via a gaming machine, comprising:

receiving a primary wager initiating a game of chance;

funding a primary prize with at least a portion of the primary wager, wherein the primary prize is a purchase and an issuance of a lottery ticket; and providing a choice of one of a plurality of lottery games from which the purchase is to be made if the primary wager results in winning the primary prize.

11. The process of claim 10, further comprising providing a choice to purchase a lottery ticket with a credit in response to receiving a request to cash out.

12. The process of claim 11, further comprising providing a choice of one of a plurality of lotteries from which the purchase is to be made in response to the choice to purchase a lottery ticket.

13. The process of claim 12, wherein the game of chance is provided by a casino and the lottery is a state-sponsored lottery.

* * * * *

UNITED STATES PATENT AND TRADEMARK OFFICE

CERTIFICATE OF CORRECTION

PATENT NO. : 7,322,885 B1
APPLICATION NO. : 10/701166
DATED : January 29, 2008
INVENTOR(S) : Robert A. Luciano, Jr. et al.

It is certified that error appears in the above-identified patent and that said Letters Patent is hereby corrected as shown below:

Column 2
In line 13, insert --be-- after "may"
In line 34, replace "diners" with --dinners--
In line 53, insert --be-- after "will"

Column 4
In line 42, replace "form" with --forms--

Column 5
In line 43, replace "award" with --aware--

Column 6
In line 11, replace "my" with --may--
In line 29, replace "back end" with --backend--

Column 7
In line 32, replace "if" with --it--
In line 66, insert --be-- before "generated"

Column 9
In line 55, insert --to-- after "visible"

Signed and Sealed this

Tenth Day of June, 2008

JON W. DUDAS
*Director of the United States Patent and Trademark Office*